US006715752B2

(12) United States Patent
Enenkel et al.

(10) Patent No.: US 6,715,752 B2
(45) Date of Patent: Apr. 6, 2004

(54) DEVICE FOR STACKING FLAT POSTAL ARTICLES

(75) Inventors: Peter Enenkel, Constance (DE); Armin Zimmermann, Constance (DE)

(73) Assignee: Siemens AG, Munich (DE)

( * ) Notice: Subject to any disclaimer, the term of this patent is extended or adjusted under 35 U.S.C. 154(b) by 0 days.

(21) Appl. No.: 10/367,899

(22) Filed: Feb. 19, 2003

(65) Prior Publication Data

US 2003/0137097 A1 Jul. 24, 2003

Related U.S. Application Data

(63) Continuation of application No. PCT/DE01/03181, filed on Aug. 21, 2001.

(51) Int. Cl.[7] ..... B65H 29/42
(52) U.S. Cl. ..... 271/179
(58) Field of Search ..... 271/179, 178

(56) References Cited

U.S. PATENT DOCUMENTS 277,806 A * 5/1883 Stonemetz et al.
2,778,638 A * 1/1957 Whillock et al.
3,712,487 A * 1/1973 Eberle
4,378,938 A * 4/1983 Staniszewski ..... 271/179
4,903,955 A * 2/1990 Manzke ..... 271/179 X
5,544,876 A * 8/1996 Ruch ..... 271/179
5,816,570 A * 10/1998 Paradis et al. ..... 271/179

* cited by examiner

*Primary Examiner*—David H. Bollinger
(74) *Attorney, Agent, or Firm*—Jacob Eisenberg; Siemens Schweiz AG

(57) ABSTRACT

The present invention relates to an apparatus for stacking articles. The articles may comprise mail pieces. The apparatus comprises a base having a top surface. The top surface defines a rake element having extending fingers defining open spaces therebetween. A receiving unit is mounted proximate to the rake. The unit may be made to rotate. The unit further comprises a plurality of coils. The coils may be helical, concentric and vertically displaced so as to define a vertical open space therebetween. When rotating, the coils may be made to move in the direction of a support positioned atop the top surface. The support may further comprise a spring bias to urge the support against a stack of articles. A supporting wall is also provided as well as a supply element which directs incoming articles into the vertical opening. The movement of the coils transports the articles to a stack which is support on one side by the support, on another by the supporting wall and on yet another by the top surface.

20 Claims, 4 Drawing Sheets

DEVICE FOR STACKING FLAT POSTAL ARTICLES

CONTINUATION DATA

The present invention is a continuation of and claims priority to international application: PCT/DE01/03181, filed Aug. 21, 2001, and further claims priority to German patent application 10041707.8, filed Aug. 24, 2000 both of which are incorporated herein by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The invention relates to a device for stacking flat postal articles, in particular large-format, thick and rigid postal articles, in an upright position on a stack receiver, consisting of a base with a supporting wall and a support which can be displaced in the direction of the stack and which is provided for holding the stack of postal articles.

Particularly for use in course-sequence sorting machines, i.e. for the repeated return of postal articles and the separation of a stack of postal articles, a high stacking quality suitable for machine operation (edge alignment of the postal articles) is necessary.

A stacker is known which uses a rotating helical coil to feed horizontal postal articles to a stack of horizontal postal articles at the end of the helical coil (U.S. Pat. No. 5,562,399). This stacker is not suitable for stacking upright postal articles of different formats and different thicknesses and rigidities, because the different-sized postal articles can jam in the helical coil and not be securely fed.

Known sorting machines for flat, large-format postal articles do not sort in a stacker that arranges the articles in a guided manner, but instead into a container by an ejection process. This normally produces a stack of postal articles in which the alignment of the articles is limited (WO 95/02467).

A solution is certainly known whereby large letters in a very wide format range are ejected into specially-shaped stacking compartments to achieve a very high stacking quality (DE 198 05 562 C1). However, only small stacks approximately 150 mm high are formed in these compartments, and they have to be removed manually. The throughput is also very low due to the relatively slow transport speed.

SUMMARY OF THE INVENTION

An advantage of the invention, stated below, is to provide a device for stacking flat postal articles that stacks flat postal articles with minimum disturbance, upright on their narrow edges, in a continuous, edge-oriented stack, regardless of thickness, rigidity and format.

The wire-shaped, centrically arranged, helical coils, fastened to the rotatable receiver, into which the fingers of the rake protrude such that the helical coils can turn in the gaps, with the individual postal articles being transported into the gap between the helical coils of a course and, standing on the fingers, being pushed through the rotating helical coils to the support or to the stack of postal articles already standing on the base, mean that each individual postal article is held, slowed down and continuously moved on separately. All movements are thus definitely reproducible. The fact that the postal articles stand on the fingers at the height described means that the articles cannot become incorrectly entangled in the helical coils.

It is thus advantageous if the helical coils have a triangular cross-section and the cross-section is aligned relative to the direction of feed of the postal articles into the helical coils, so that sticking or entanglement of bent or kinked postal articles in the helical coils is largely prevented.

In order to be able additionally to guide the largest postal articles safely, the height of the outermost helical coils above the fingers advantageously corresponds almost to the height of the largest postal article.

In a further advantageous embodiment, the individual postal articles are fed from above into the area of the course of the helical coils, in that the movement of the helical coils is directed toward the supporting wall and/or the base. The effect of this is that the postal articles are aligned toward the fingers and supporting wall due to the frictional driving forces at the helical coils.

To prevent a rebound of the postal articles from the fingers at high injection speeds from above, the fingers are advantageously provided with an impact-absorbing surface.

It is also advantageous if the base is designed as an under-floor conveyor which together with the support is displaced away from the stacking point corresponding to the thickness of the particular postal article to be stacked. This correspondingly relieves the load on the helical coils.

In a further advantageous embodiment, the support is not actively driven, but instead is pressed with the aid of a spring element against the stack of postal articles over the complete movement path. In conjunction with a non-driven base, this results in a very cost-effective design.

In order to further reduce the feed forces required to form a stack, it is advantageous to disengage the fingers using narrow circulating belts, which can be synchronously driven by the under-floor conveyor of the base and also operated without a drive to reduce the coefficient of friction.

An additional advantage of the present invention lay in an apparatus for stacking articles in a stack, comprising a base comprising a top surface for supporting said a first side of said stack, said top surface comprising a rake formation comprising a plurality of adjacent fingers defining openings through said top surface between said fingers; a rotatable receiver vertically mounted proximate to said fingers and openings, said receiver comprising a plurality of substantially concentric vertically displaced coils, running in said openings, adjacent vertically displaced coils in cooperating with said fingers defining a vertical opening between said coils; a supporting wall for providing support to a second side of said stack, said wall abutting said base; and a support for supporting a third side of said stack, said support functionally associated with said base so as to be displaceable along said base in a direction of said stack.

Other features and advantages of the present invention will become evident from the specification and claims below.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

Figure 1:
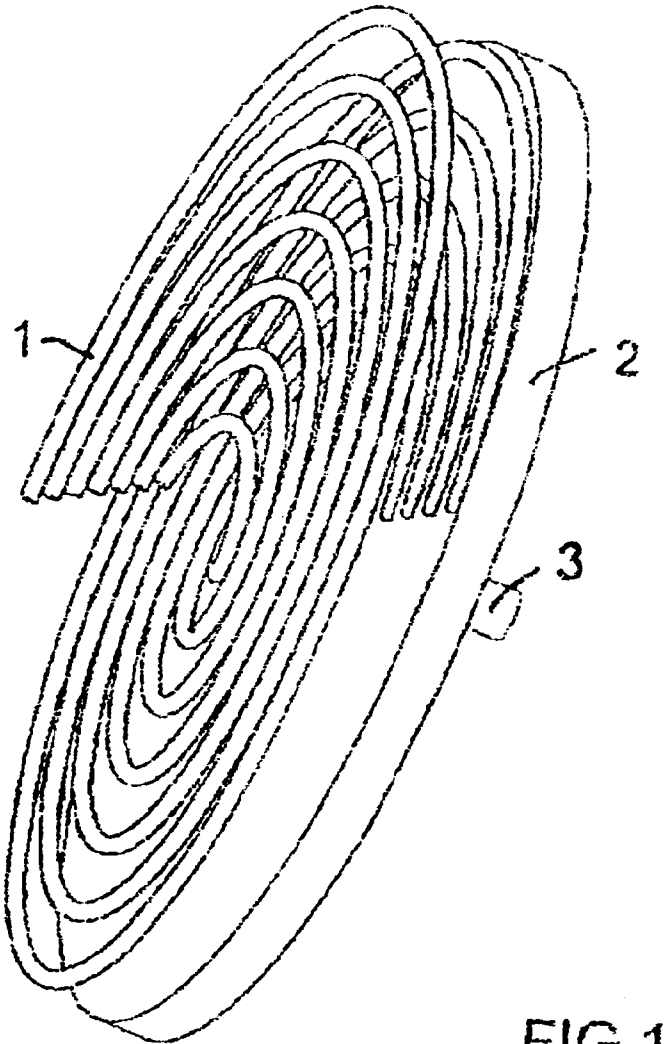
FIG. 1 depicts a perspective view of the helical coils fastened to a receiver.

The present invention will now be described with respect to the stacking of postal articles, although stacking of other articles and/or objects is within the scope of the invention. FIG. 1 is a round receiver 2 with a shaft 3, to which wire-shaped, centrically arranged, uniformly circular helical coils I are fastened. Each helical coil 1 has a different helical coil diameter, but the same or substantially similar slope and 1½ courses or turns. The actual number of courses or turns is a matter of design choice matched with application. The coils are vertically displaced and substantially concentric. As such, adjacent vertically displaced coils form a space therebetween. The slope of the coils is chosen such that the thickest postal packages to be stacked may fit and/or pass between the helical coils of a course.

Figure 2:
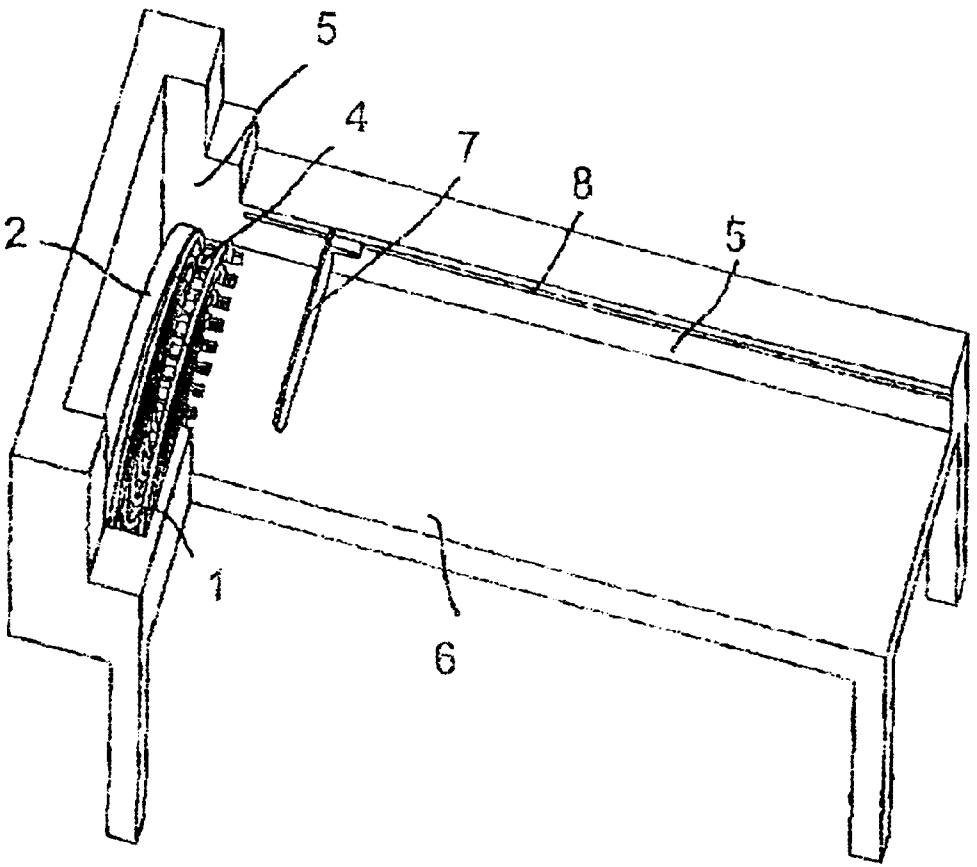
FIG. 2 depicts a schematic perspective view of a stacking device without guides and postal articles.

FIG. 2 depicts a base 6 and a supporting wall 5 arranged vertically relative to it, on which the upright postal articles with aligned edges are stacked against a support 7 guided on a guide rail 8. The support 7 is pressed against the first postal article of the stack along the complete length of the stack receiver by means of a flat spring (not shown) with a flat characteristic curve. Other biasing means known in the art may be substituted. The base 6 has a good sliding surface in that it is relatively frictionless. This facilitates movement of articles thereon. At the stack input point the view of the guides concealing the helical coils 1 is removed from the drawing.

In an extension of the base 6 at the stack input point with the helical coils 1 fastened to the rotatable receiver 2 is a rake with fingers 4 (the rake is shown as part of the base 6). The width of the fingers 4, their spacing, as well as the helical coil diameter and the thickness of the helical coils 1 are matched to each other such that the helical coils can easily turn in the gaps between the fingers 4. In other words, the fingers are adjacent and the space in between the fingers defines an opening within the surface of the base. These openings are selected so as to allow the coils to turn therein.

The length of the fingers 4 is chosen so that they protrude without gaps between the helical coils 1 of the course so that postal articles standing on the fingers 4 cannot become trapped or slide through between the helical coils 1 and fingers 4. The level of the base 6 and of the fingers 4 is at the height within the area of the innermost helical coil 1, i.e. the entangling of postal articles in the helical coils 1 is thus largely avoided. The danger of entanglement in the helical coils 1 is also reduced in that the helical coils have a triangular cross-section with the apex pointing in the injection direction. This means that if the postal articles on the way downwards touch the helical coils I they are diverted away from the helical coils 1. The supporting wall 5 is extended inwards in the area of the stack input point, to guarantee alignment in the helical coil area.

Figure 3:
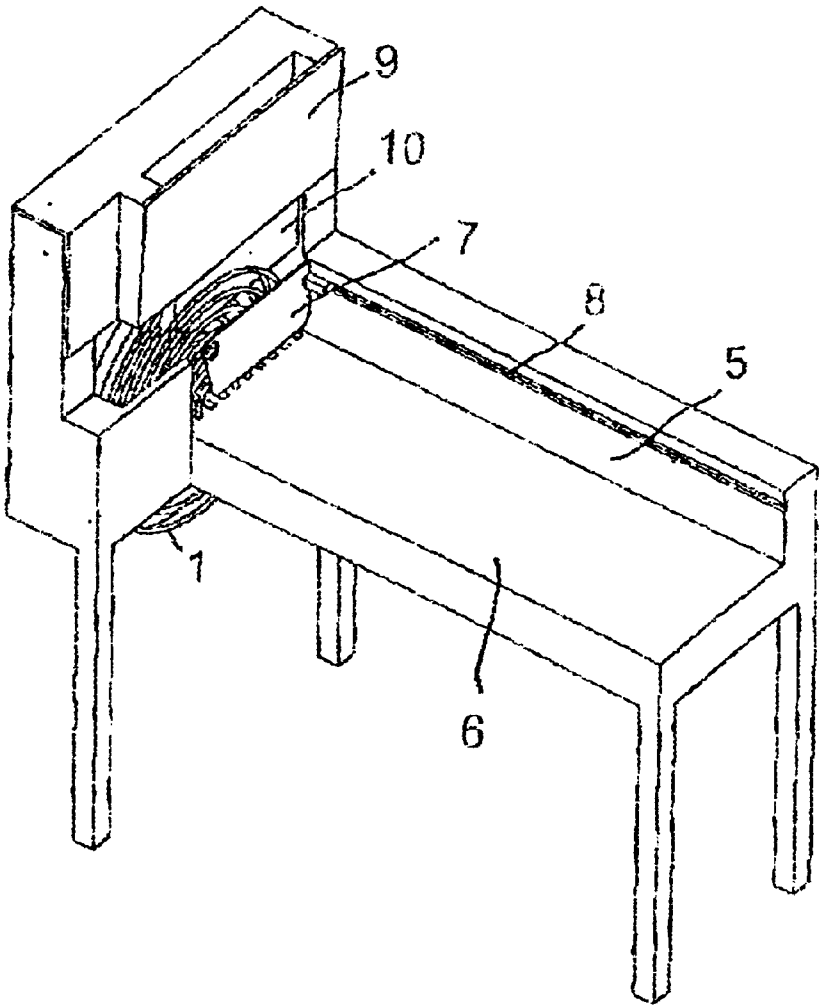
FIG. 3 depicts a schematic perspective view of a stacking device with a guide, through which the first postal article is just being guided between the helical coils of the course.

FIG. 3 shows a guide 9 through which the postal articles are passed from above between the course of the helical coils 1. As can be seen, the first postal article 10 is just sliding down. After the postal article 10 has left the guide 9 and is standing on the fingers 4, the receiver 2 rotates with the helical coils 1 in a clockwise direction and thus pushes the postal article 10 to the support 7, which is thus moved back slightly against spring force.

Figure 4:
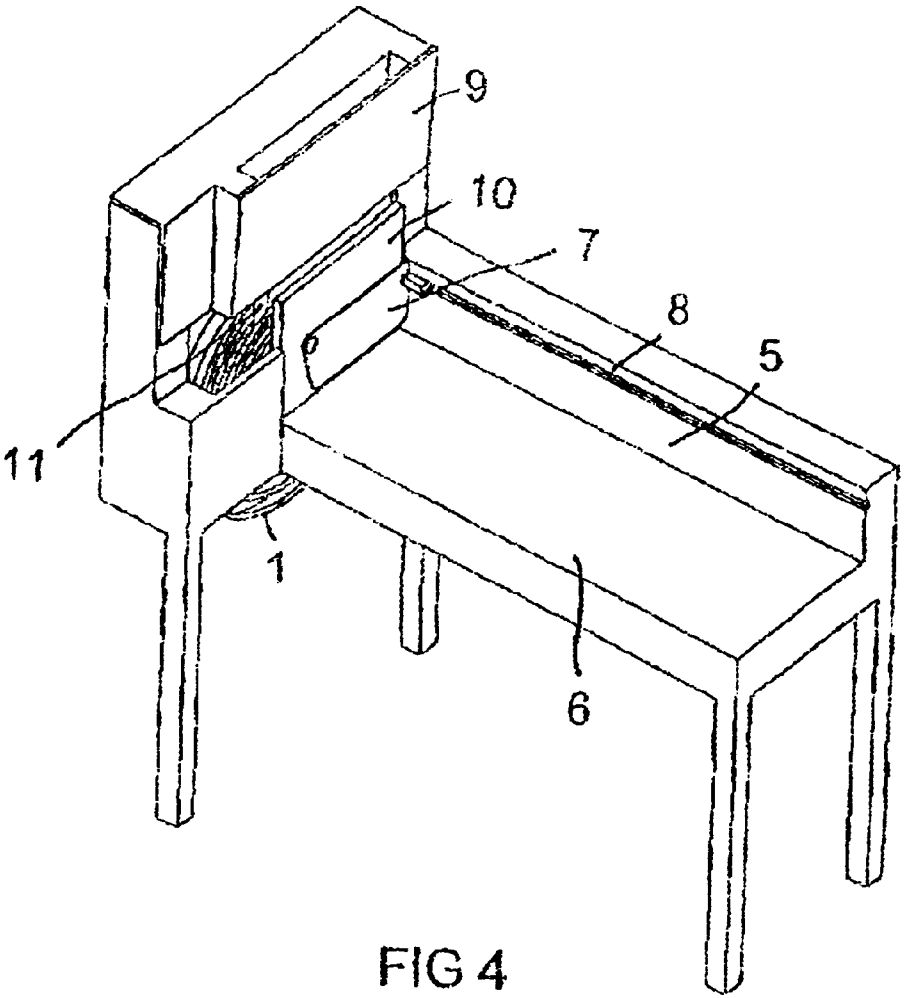
FIG. 4 depicts a schematic perspective view of the stacking device with a guide through which the second postal article is just being guided between the helical coils of the course.

So that the postal article 10 and the other postal articles are aligned toward the base 6 and the supporting wall 5 when sliding in the helical coils, they are guided downwards in that the helical coils 1 have a moving component directed toward the fingers 4 and supporting wall 5 when turning, so that an alignment results due to the frictional driving force. FIG. 4 depicts how a second postal article 11 is just sliding downwards while the first postal article 10 has meanwhile been pushed against the support 7. Returning to the fingers, they may further include dampening features which dampen the impact of the mail piece and finger, as the mail piece descends into the course. The fingers may further include conveyor belts and the like which selectively urge the article in a select direction. A further conveyor belt and the like may be included under the base surface to further selectively urge articles. The two conveyor belts may be synchronized, by control means known in the art, to cooperate in applying selective urging strength and/or resistance to present articles.

This exemplary embodiment represents a very advantageous design, but is not restrictive. Thus, for example, it is also possible to inject the postal articles 10, 11 sideways to the supporting wall 5 without difficulty. The invention being thus described, it will be obvious that the same may be varied in many ways. The variations are not to be regarded as a departure from the spirit and scope of the invention, and all such modifications as would be obvious to one skilled in the art are intended to be included within the scope of the following claims.

We claim:

1. An apparatus for stacking articles in a stack, comprising:

a base comprising a top surface for supporting said a first side of said stack, said top surface comprising a rake formation comprising a plurality of adjacent fingers defining openings through said top surface between said fingers;

a rotatable receiver vertically mounted proximate to said fingers and openings, said receiver comprising a plurality of substantially concentric vertically displaced coils, running in said openings, adjacent vertically displaced coils in cooperating with said fingers defining a vertical opening between said coils;

a supporting wall for providing support to a second side of said stack, said wall abutting said base; and a support for supporting a third side of said stack, said support functionally associated with said base so as to be displaceable along said base in a direction of said stack.

2. The apparatus according to claim 1, wherein said articles comprise mail pieces.

3. The apparatus according to claim 1, wherein said fingers are substantially coplanar to said top surface.

4. The apparatus according to claim 1, wherein said coils define a substantially similar curvature.

5. The apparatus according to claim 1, wherein said coils define an innermost coil having a smallest radius and an outermost coil having a largest radius, in comparison to remaining coils.

6. The apparatus according to claim 5, wherein said top surface is approximately co-planar along a trajectory running through said smallest radius.

7. The apparatus according to claim 5, wherein said largest radius is approximately equal to a height of a tallest mail piece to be stacked.

8. The apparatus according to claim 1, wherein said coils are helical.

9. The apparatus according to claim 8, wherein said helical coils define a triangular cross-section.

10. The apparatus according to claim 1, wherein said coils are wire shaped.

11. The apparatus according to claim 1, wherein said coils comprise different diameters.

12. The apparatus according to claim 1, wherein each of said coils have a substantially similar slope.

13. The apparatus according to claim 1, wherein said supporting wall is angled towards of said base.

14. The apparatus according to claim 1, wherein said coils comprise a movement in a direction of said supporting wall.

15. The apparatus according to claim 14, further comprising a guide positioned above said coils so as to direct incoming articles into said at least one vertical opening such that said article comes to rest within said at least one vertical opening and is supported from below by said fingers.

16. The apparatus according to claim 15, wherein upper surfaces of said fingers further comprise shock absorbing means for an impact of said article to said finger.

17. The apparatus according to claim 1, wherein said support functional association comprises a spring urging means for urging said support against said stack.

18. The apparatus according to claim 1, wherein said top surface further comprises conveyor means for conveying said articles.

19. The apparatus according to claim 18, wherein said fingers comprise conveyor belts.

20. The apparatus according to claim 19, further comprising means for synchronizing conveying direction and speed of said conveyor belts and conveyor means.

* * * * *